US008438684B2

(12) United States Patent
Mastio et al.

(10) Patent No.: US 8,438,684 B2
(45) Date of Patent: May 14, 2013

(54) APPARATUS FOR CLEANING AN IMMERSED SURFACE WITH GYRATION USING AT LEAST ONE LATERALLY OFFSET NON-DRIVING ROLLING MEMBER

(75) Inventors: Emmanuel Mastio, Fourquevaux (FR); Philippe Blanc-Tailleur, Toulouse (FR); Philippe Pichon, Villeneuve de Riviere (FR)

(73) Assignee: Zodiac Pool Care Europe, Paris (FR)

( * ) Notice: Subject to any disclaimer, the term of this patent is extended or adjusted under 35 U.S.C. 154(b) by 200 days.

(21) Appl. No.: 12/971,314

(22) Filed: Dec. 17, 2010

(65) Prior Publication Data

US 2011/0155186 A1 Jun. 30, 2011

Related U.S. Application Data

(60) Provisional application No. 61/300,540, filed on Feb. 2, 2010.

(30) Foreign Application Priority Data

Dec. 18, 2009 (FR) ..... 09 06140

(51) Int. Cl.
*E04H 4/16* (2006.01)

(52) U.S. Cl.
USPC ..... 15/1.7; 210/167.16

(58) Field of Classification Search ..... 15/1.7, 15/167.16, 169
See application file for complete search history.

(56) References Cited

U.S. PATENT DOCUMENTS

| | | | | |
|---|---|---|---|---|
| 5,245,723 | A | 9/1993 | Sommer | |
| 6,187,181 | B1 * | 2/2001 | Stoltz et al. | 210/122 |
| 7,213,287 | B2 * | 5/2007 | Hui | 15/1.7 |
| 2004/0168838 | A1 | 9/2004 | Erlich et al. | |
| 2006/0065580 | A1 * | 3/2006 | Henkin et al. | 210/97 |

FOREIGN PATENT DOCUMENTS

| | | |
|---|---|---|
| EP | 1022411 | 7/2000 |
| EP | 1070850 | 1/2001 |
| FR | 2584442 | 1/1987 |
| FR | 2586054 | 2/1987 |
| FR | 2896005 | 7/2007 |
| FR | 2567552 | 6/2009 |
| FR | 2925553 | 6/2009 |
| FR | 2925558 | 6/2009 |
| WO | WO8700883 | 2/1987 |
| WO | WO0250388 | 6/2002 |
| WO | WO2009081044 | 7/2009 |
| WO | WO2009081060 | 7/2009 |

* cited by examiner

*Primary Examiner* — Shay Karls
(74) *Attorney, Agent, or Firm* — Dean W. Russell; Kilpatrick Townsend & Stockton LLP

(57) ABSTRACT

The invention relates to an apparatus for cleaning a surface which is immersed in a liquid, comprising a hollow body, members which are integral with the hollow body and which come into contact with the immersed surface, a filtration chamber, at least one electric motor which is carried by the hollow body, and a control unit which is configured to control the motor. For at least one movement configuration of the apparatus, at least one non-steering non-driving rolling member in contact with the immersed surface is arranged relative to the instantaneous drive orientation so as to apply a gyration torque of the apparatus only due to such an arrangement.

14 Claims, 6 Drawing Sheets

Figure 3:
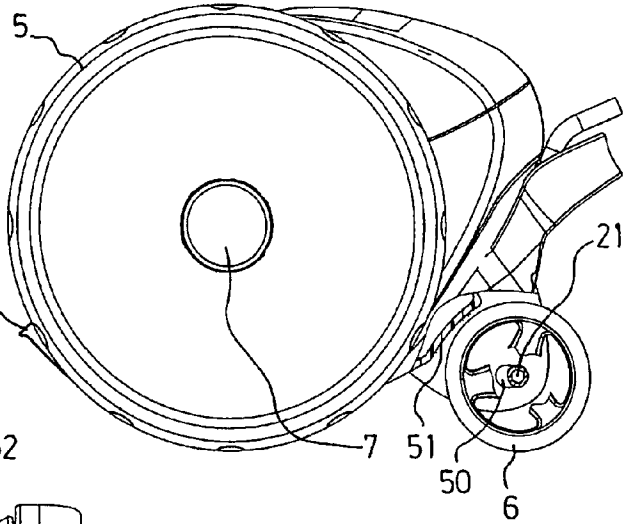

APPARATUS FOR CLEANING AN IMMERSED SURFACE WITH GYRATION USING AT LEAST ONE LATERALLY OFFSET NON-DRIVING ROLLING MEMBER

This application claims the benefit of French Patent Application No. 09.06140 filed on Dec. 18, 2009 and claims the benefit of U.S. Provisional Application No. 61/300,540 filed on Feb. 2, 2010, the contents of both of which are incorporated herein by reference.

The invention relates to an apparatus for cleaning a surface which is immersed in a liquid, such as the walls of a swimming pool, of the type with (an) electric motor(s).

There are a great number of apparatus of this type which have been known for some time (cf. typically FR 2 567 552, FR 2 584 442, etc.) and they generally comprise a hollow body; one (or more) electric drive motor(s) which is/are coupled to one or more member(s) for driving said body over the immersed surface; and an electric pumping motor which drives a pumping member, such as a propeller, which generates a liquid flow between at least one liquid inlet and at least one liquid outlet and through a filtration chamber.

These apparatus are satisfactory but are relatively heavy and costly to produce and use, in particular in terms of electrical consumption.

There have already been proposed apparatus with a single electric motor which serve to simultaneously bring about the driving of the apparatus and the pumping of the liquid. However, these apparatus present a problem in terms of cleaning efficiency (speed and/or quality of sweeping the entire surface and/or debris pumping capacity), which assumes in particular that the apparatus can move forwards or backwards along varied trajectories, which may be straight or curved, to the left and to the right.

In prior apparatus in which the pumping is ensured by an on-board electric motor, and the driving is also ensured by at least one on-board electric motor, if the apparatus must be bi-directional, that is to say, able to carry out forward and backward trajectories, the possibility is generally excluded of using the electric pumping motor for moving the apparatus, unless a pumping member such as a "vortex" pump or a centrifugal pump is provided (cf. for example U.S. Pat. No. 5,245,723), or a pump with articulated blades (cf. for example EP 1 070 850), which is capable of providing a flow of liquid in the same direction regardless of the rotation direction thereof, but whose pumping performance levels are mediocre. Furthermore, these apparatus provide poor sweeping coverage of the immersed surface which is either not completely cleaned or is completely cleaned only at the end of an excessively long period of time.

In another category of apparatus, there is provision for the driving and/or orientation of the apparatus to be at least partially carried out by the hydraulic reaction brought about by the flux generated by the pumping action (cf. for example FR2925558, FR2925553, etc.).

EP 1 022 411 (or US 2004/0168838) also describes an apparatus which is capable of being partially driven by the hydraulic flux created and has two nozzle outlets which have opposing directions and which are supplied alternately via a valve which is operated by a programming device when the pump is stopped. Owing to wheels which are self-pivoting or which have pivoting axles, the forward and backward trajectories are different. However, apparatus of this type are relatively complex, costly and unreliable, in particular with regard to the control of the tilting of the valve (or more generally for the change in direction of the hydraulic flux) which requires an operating logic unit and/or at least one on-board actuator and/or a specific mechanism which is capable of being locked.

An object of the invention is therefore generally to provide a cleaning apparatus of the type having (an) on-board electric motor(s) which is both more economical in terms of production and use and which has high performance levels which are comparable with those of known apparatus, in terms of quality and cleaning, and more particularly which provides complete and rapid sweeping of the immersed surface and good suction quality for collecting waste with a satisfactory performance level in terms of energy.

An object of the invention is thus to provide an apparatus of this type which is particularly simple, compact and light but which has significant movement possibilities.

An object of the invention is in particular to provide an apparatus of this type which comprises a single electric on-board drive and pumping motor and which can be driven simply in a plurality of—in particular at least three—different predetermined trajectories, in particular in a straight line, or round a bend at one side and round a bend at the other side.

An object of the invention is also to provide an apparatus of this type whose electric control unit is particularly simple and economical and can be located entirely out of the liquid.

The invention therefore relates to an apparatus for cleaning a surface which is immersed in a liquid, comprising:

- a hollow body,
- at least one electric motor which is carried by said hollow body and which comprises a drive shaft which is mechanically connected to at least one guiding and driving member, called a motorized member, which is arranged so as to move the hollow body over the immersed surface in an instantaneous drive orientation and in one direction or the other relative to an instantaneous drive orientation,
- at least one non-steering non-driving rolling guiding member which is rotatably mounted relative to the hollow body about a transverse axis orthogonal with respect to said instantaneous drive orientation,
- a filtration chamber which is provided in said hollow body and which has:
- at least one liquid inlet into the hollow body,
- at least one liquid outlet out of the hollow body,
- a hydraulic circuit for circulation of liquid between each liquid inlet and each liquid outlet through a filtering device,
- an electric control unit which is configured to supply and control each motor, characterized in that at least one non-steering non-driving rolling guiding member is, for at least one movement configuration of the apparatus on the immersed surface, arranged relative to the instantaneous drive orientation so as to apply a gyration torque of the apparatus which is only due to such an arrangement.

An apparatus according to the invention is therefore driven in terms of gyration in a curved trajectory at one side owing only to the movement configuration of the apparatus, that is to say, its movement direction and/or its movement speed and/or its position relative to the instantaneous drive orientation (that is to say, its orientation relative to the instantaneous drive orientation in a plane which is orthogonal to the immersed surface and which contains the instantaneous drive orientation), this position being able to be dependent, for example, on the drive speed of each motorized member.

Advantageously and according to the invention, for at least one movement configuration of the apparatus on the immersed surface, the arrangement relative to the instantaneous drive orientation of each non-steering non-driving rolling guiding member is adapted to apply a gyration torque of the apparatus at one side which is only due to such an arrangement. That is to say, the distribution of said at least one non-steering non-driving rolling guiding member is asymmetrical, laterally offset at one side relative to a longitudinal center plane which contains the instantaneous drive orientation and which is orthogonal relative to the immersed surface.

Advantageously and according to the invention, said distribution of said at least one non-steering non-driving rolling guiding member in contact with the immersed surface is configured to generate a friction resistance which is asymmetrical relative to the instantaneous drive orientation and therefore relative to said plane which is orthogonal relative to the immersed surface and which contains the instantaneous drive orientation This asymmetrical friction resistance therefore produces a gyration torque of the apparatus at one side relative to the instantaneous drive orientation. It should be noted that this asymmetrical friction resistance can be obtained with a symmetrical distribution of the non-steering, non-driving rolling guiding member(s), for example by braking only one non-steering, non-driving rolling guiding member located at one side of the apparatus.

Furthermore, advantageously and according to the invention, for a first movement configuration of the apparatus, the distribution of guiding members in contact with the immersed surface is adapted to bring about a movement of the apparatus according to a first trajectory (in a straight line or in terms of gyration at a first side) and, for at least a second movement configuration of the apparatus which is different from said first configuration, the distribution of the guiding members in contact with the immersed surface is adapted to bring about a movement of the apparatus according to a second trajectory which is different from said first trajectory. Such a second trajectory has a different shape from the first trajectory. In this manner, if the first trajectory is in a straight line, at least one second trajectory corresponds to a gyration of the apparatus at one side, and if the first trajectory corresponds to a gyration of the apparatus at one side, at least a second trajectory is in a straight line or in gyration with a different radius or a different gyration direction.

Advantageously and according to the invention, said first movement configuration corresponds to a first movement direction of the apparatus and at least a second movement configuration of the apparatus corresponds to a second movement direction of the apparatus opposite said first movement direction. In this manner, in a first movement direction of the apparatus and for at least one movement configuration of the apparatus in this first movement direction, the distribution of the guiding members in contact with the immersed surface is adapted to bring about a movement of the apparatus according to a first trajectory, and in a second movement direction of the apparatus and for at least one movement configuration of the apparatus in this second movement direction, the distribution of said guiding members in contact with the immersed surface is adapted to bring about a movement of the apparatus according to a second trajectory which is different from said first trajectory.

By changing the movement direction, the movement configuration of the apparatus is changed and the gyration torque applied by the members in contact with the immersed surface is modified so that the trajectory of the apparatus is also modified.

In a variant or in combination, at least a second movement configuration of the apparatus corresponds to a movement thereof in the first movement direction, but the operating mode of the apparatus is modified between the first configuration and the second configuration. This modification of the operating mode may involve in particular a modification of the position of the apparatus relative to the immersed surface and/or a modification of the drive speed of the apparatus and/or a modification of the features of the circulation of the liquid in the hydraulic circuit, for example a reversal of the circulation direction of the liquid.

In this manner, in some embodiments of the invention, the position of the apparatus in a movement direction can be modified in accordance with the speed thereof and/or the speed of a pumping motor and/or the pumping direction of the liquid so that the distribution of the members in contact with the immersed surface is also modified, the gyration torque of the apparatus also being modified (and cancelled if necessary).

In other embodiments, however, the position of the apparatus may be invariable. In these embodiments, however, it is possible to make provision for the distribution of the members in contact with the immersed surface in at least one movement direction to be modified in accordance with the speed of the apparatus in this movement direction. For example, a non-steering, non-driving rolling member in contact with the immersed surface for a first slow speed may be provided with a fin which allows the position of the member to be modified relative to the hollow body in accordance with the hydraulic reaction, and in particular allows this member of the immersed surface to be braked from a more rapid speed.

A non-steering non-driving rolling guiding member is in contact with the immersed surface for at least one position of the apparatus and in at least one movement direction. Such a non-steering non-driving rolling guiding member is non-steering in the direction that it is mounted so as to rotate relative to the hollow body about an axis which is and remains (even if it may move in translation in some embodiments of the invention) transverse, that is to say, orthogonal relative to the instantaneous drive orientation—in particular parallel with the axis (fixed relative to the hollow body) of each driving rolling guiding member—and parallel with the immersed surface. In this manner, if the distribution of said at least one non-steering, non-driving rolling guiding member(s) is symmetrical relative to a longitudinal center plane which contains the instantaneous drive direction and which is orthogonal relative to the immersed surface and if the non-steering, non-driving rolling guiding member(s) is/are not braked, no gyration of the apparatus is produced. Preferably, advantageously and according to the invention, this laterally offset non-driving rolling member is freely rotative about a transverse axis in a first movement direction of the apparatus and, wherein said at least one non-steering non-driving rolling member is braked in another movement direction of the apparatus.

Advantageously and according to the invention, at least one laterally offset non-steering, non-driving rolling member is a non-driving wheel which is rotatably mounted relative to the hollow body about a transverse axis. Other embodiments are possible, in particular several non-driving wheels of a non-driving axle which are laterally offset relative to drive wheels of a drive axle.

In this manner, an apparatus according to the invention is advantageously characterized in that it comprises a drive axle, and in that at least one laterally offset non-steering non-driving rolling member is arranged so as to be in contact with the immersed surface in front of the drive axle in at least one movement direction.

Furthermore, according to another construction variant of the invention, which can be combined with one and/or other of the preceding variants, said guiding members in contact with the immersed surface comprise at least one runner which is laterally offset relative to a longitudinal plane of the apparatus which contains the instantaneous drive orientation and which is orthogonal with respect to the immersed surface.

Advantageously and according to the invention, at least one runner is arranged so as to come into contact with the immersed surface in a nosed-up position of the apparatus in order to produce a gyration of the apparatus at one side.

Such a runner is inactive (remote from the immersed surface) when the hollow body is in its normal operating position (cleaning the immersed surface) and can be adapted to only locally brake the hollow body when it is in a predetermined nosed-up position. In a variant, such a runner can be adapted to locally disengage the hollow body, and at least one motorized guiding and driving member which is located close to the runner. Furthermore, such a runner is arranged so as to be laterally offset relative to the drive axle in order to produce a braking or disengagement of the motorized guiding and driving member.

Furthermore, an apparatus according to the invention advantageously comprises:

- a single drive axle which is provided with at least one rolling driving member which is driven in rotation in one direction or the other about an axis of said drive axle,
- a single non-steering, non-driving axle which comprises at least one non-steering non-driving rolling member which is rotatably mounted relative to the hollow body about an axis of the non-steering non-driving axle whose orientation relative to the hollow body remains parallel with that of the axis of the drive axle in the two movement directions of the apparatus.

Advantageously and according to the invention, the non-steering, non-driving axle comprises a single non-steering non-driving rolling member laterally offset at one side relative to a center plane of the drive axle, this center plane being orthogonal with respect to the axis thereof.

Furthermore, an apparatus according to the invention advantageously comprises:

- at least one pumping member which is arranged so as to generate a flow of liquid between each liquid inlet and each liquid outlet, each pumping member being formed by an axial pumping propeller with a unidirectional pitch which creates a flux of liquid which is generally orientated along a rotation axis thereof,
- a single reversible electric motor which is carried by said hollow body and which comprises a drive shaft which is simultaneously coupled to:

each driving member of the drive axle in order to move it, each pumping propeller.

An apparatus according to the invention can therefore be simplified to an extreme degree, but nonetheless provided with different trajectories which confer thereon a great cleaning efficiency.

In a preferred embodiment according to the invention, said electric control unit is configured to control the motor in a first rotation direction of the drive shaft in accordance with a single speed, and in a second rotation direction of the drive shaft in accordance with a speed selected from at least two different speeds, including at least a first speed at which the apparatus moves into a first movement position'which may or may not be nosed-up and at least a second speed at which the apparatus moves into a second nosed-up movement position.

More particularly, advantageously and according to the invention, in a first rotation direction of the drive shaft, the drive axle is at the front of the apparatus relative to the movement direction of the apparatus, called a forward direction, and each pumping propeller is rotatably driven in a normal pumping direction in order to generate a flux of liquid from each liquid inlet as far as each liquid outlet. And in a second rotation direction of the drive shaft, the drive axle is at the rear of the apparatus relative to the movement direction of the apparatus, called a backward direction, and each pumping propeller is rotatably driven in a backward pumping direction so as to generate a flux of liquid in a backward direction from each liquid outlet. This liquid flux in a backward direction may generate, at the outlet of the hollow body, a hydraulic reaction which tends to drive the hollow body in terms of nosing-up pivoting about the axis of the drive axle.

The pivoting of the apparatus and its control in accordance with each nosed-up position can be obtained in different ways. In particular, this pivoting may result from a torque generated by inertia during an acceleration of each driving member and/or by means of a hydraulic reaction generated by the circulation of the liquid in the hollow body and during discharge out of the hollow body, the orientation and/or the amplitude of said hydraulic reaction being adapted to at least participate in placing the apparatus in a nosed-up position.

Advantageously and according to the invention, said control unit is connected to the pumping device in order to control it so that, when each drive motor is controlled in one direction and in a speed corresponding to a nosed-up position, the pumping device generates a flux of liquid which produces a hydraulic reaction, called a hydraulic nosing-up reaction, whose direction does not intersect with the axis of the drive axle and is orientated in the correct direction in order to at least participate in the nosing-up action of the hollow body about the drive axle. Preferably and according to the invention, the pumping device is reversible so as to be able to generate a flow of liquid in a backward direction from each liquid outlet and the hydraulic nosing-up reaction is produced when the pumping device is controlled by the electric control unit in a backward direction.

Furthermore, advantageously in an apparatus according to the invention, said electric control unit is configured to control the motor in a second rotation direction of the drive shaft at a speed selected from:

- a first slow speed at which the apparatus is in a first movement position relative to the immersed surface and moves in a movement direction, called a backward direction, in accordance with a first predetermined trajectory,
- a second rapid speed at which the apparatus is in a second nosed-up movement position in which it is at least partially raised relative to the immersed surface by means of pivoting about the axis of the drive axle, by means of which the apparatus moves in a backward direction in accordance with a second predetermined trajectory which is specific to the second nosed-up position and which is different from said first trajectory. More specifically, advantageously and according to the invention, said electric control unit is adapted to control the motor in a forward direction at a predetermined speed and in a backward direction at a speed selected from the first slow speed at which the apparatus is in a first movement position and the second rapid speed at which the apparatus is in a second nosed-up movement position.

More specifically, preferably, in an apparatus according to the invention, said electric control unit is configured to control the motor principally in a forward direction, and to control the motor from time to time in a backward direction in accordance with the first speed and from time to time in a backward direction in accordance with the second speed.

The different periods of time for controlling the apparatus in the different trajectories can be predetermined or defined in a random manner and can be optimized, for example in accordance with the application. In this manner, advantageously and according to the invention, said electric control unit is configured to control at least one predetermined period of operating time for the motor in one direction and at one speed, and/or in a random manner at least one period of operating time for the motor in one direction and at one speed.

The invention also relates to an apparatus characterized in combination by all or some of the features mentioned above or below.

Figure 2:
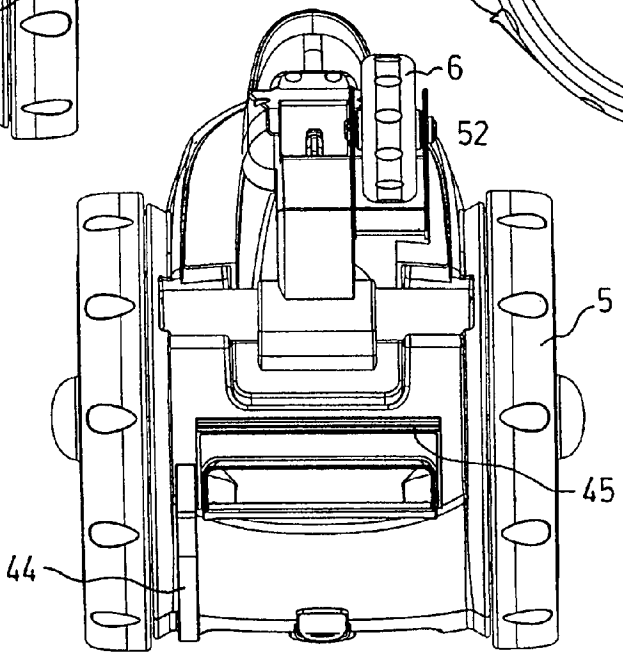
Figure 1:
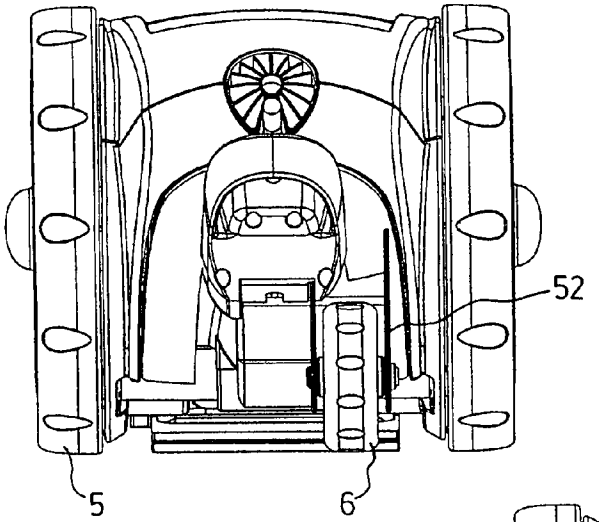
Figure 4:
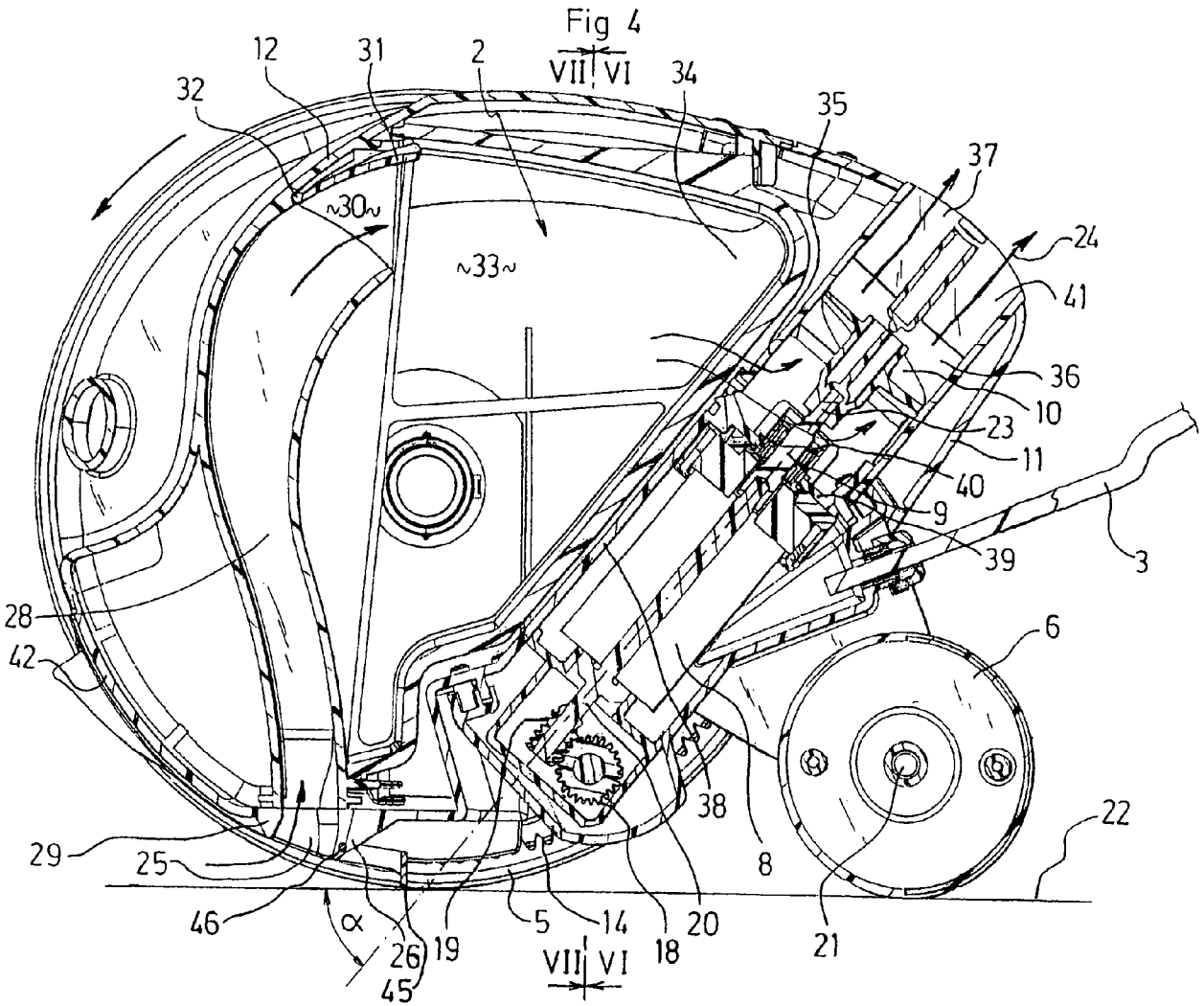
Figure 5:
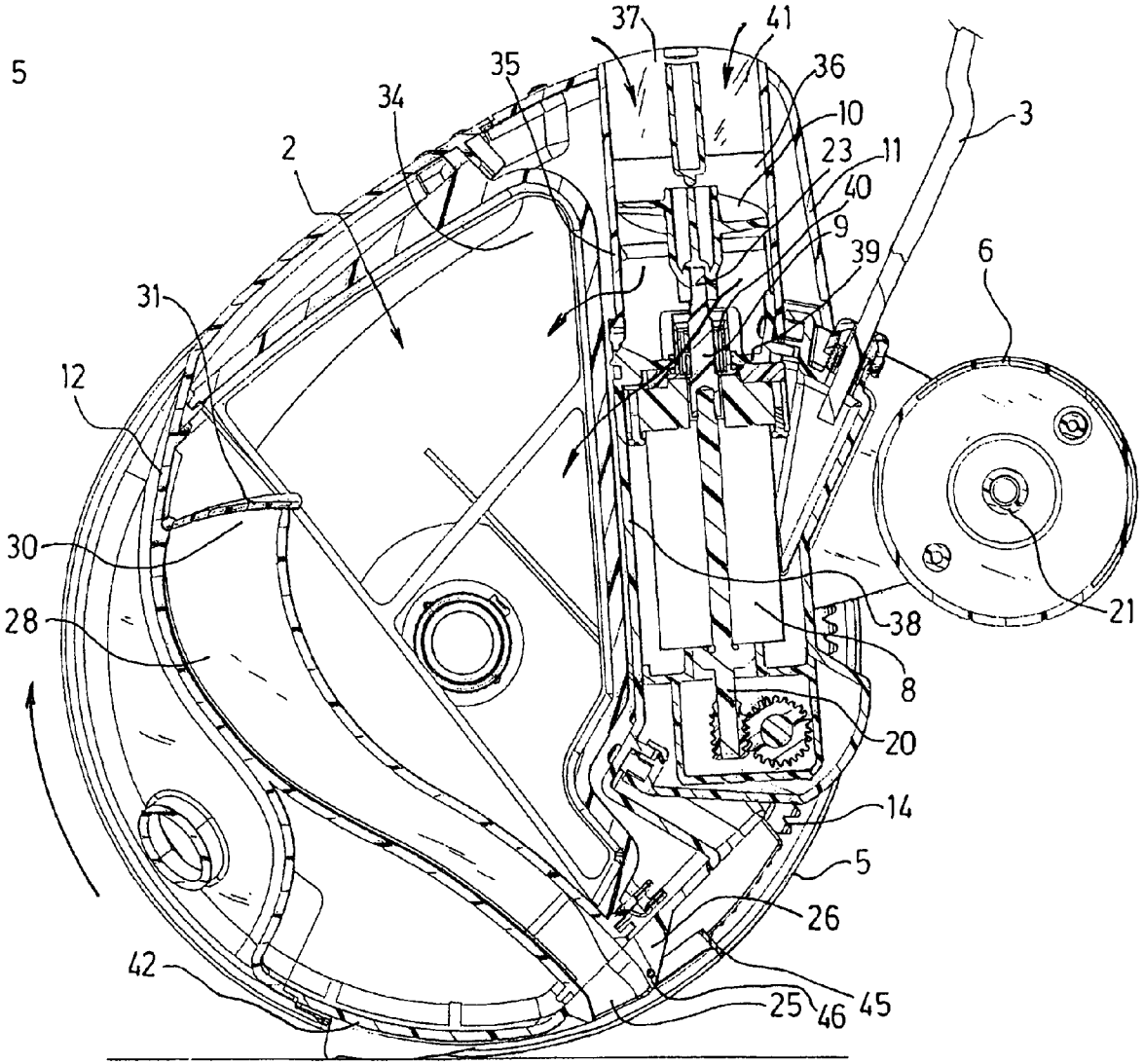
Figure 6:
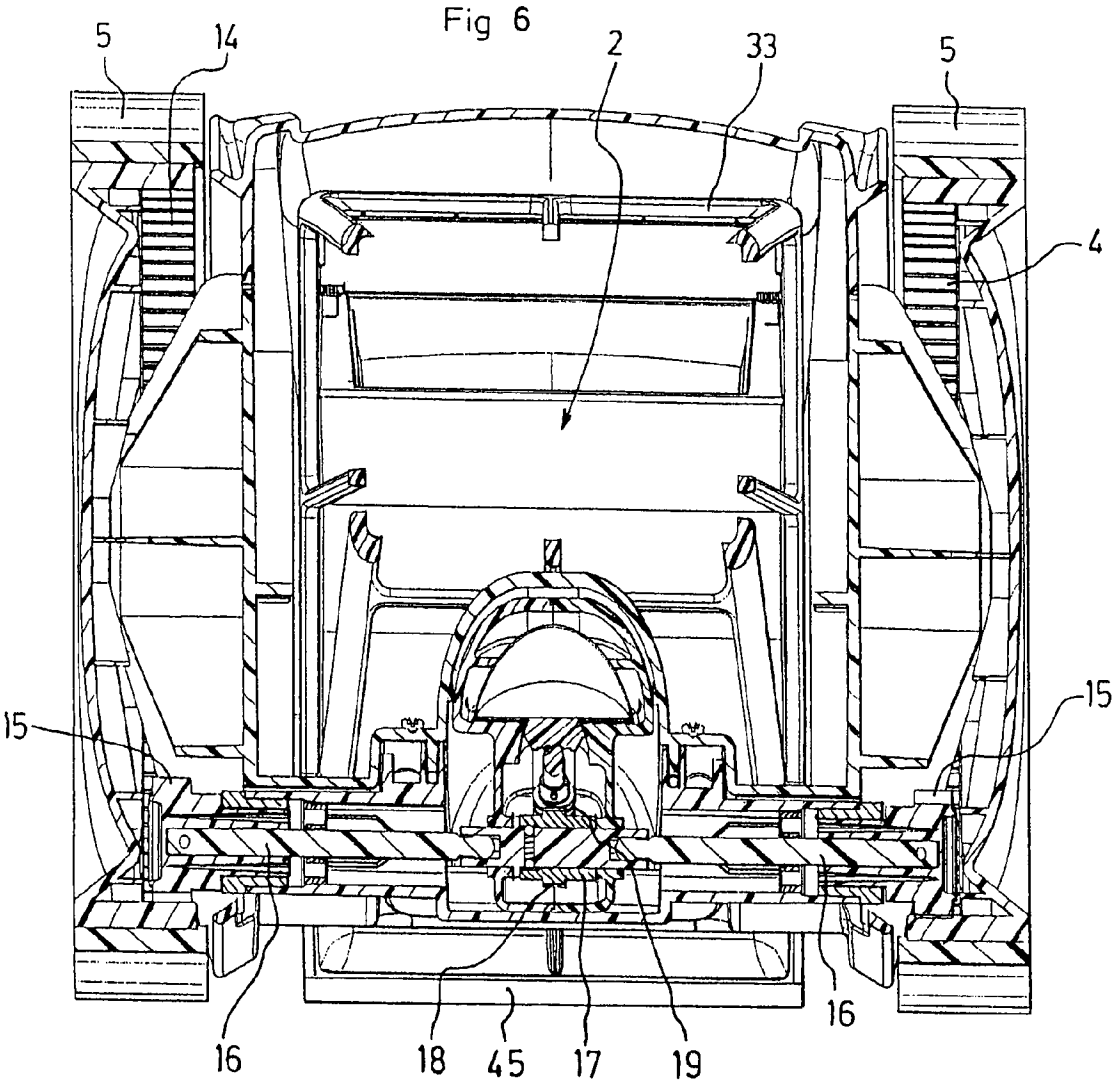
Figure 7:
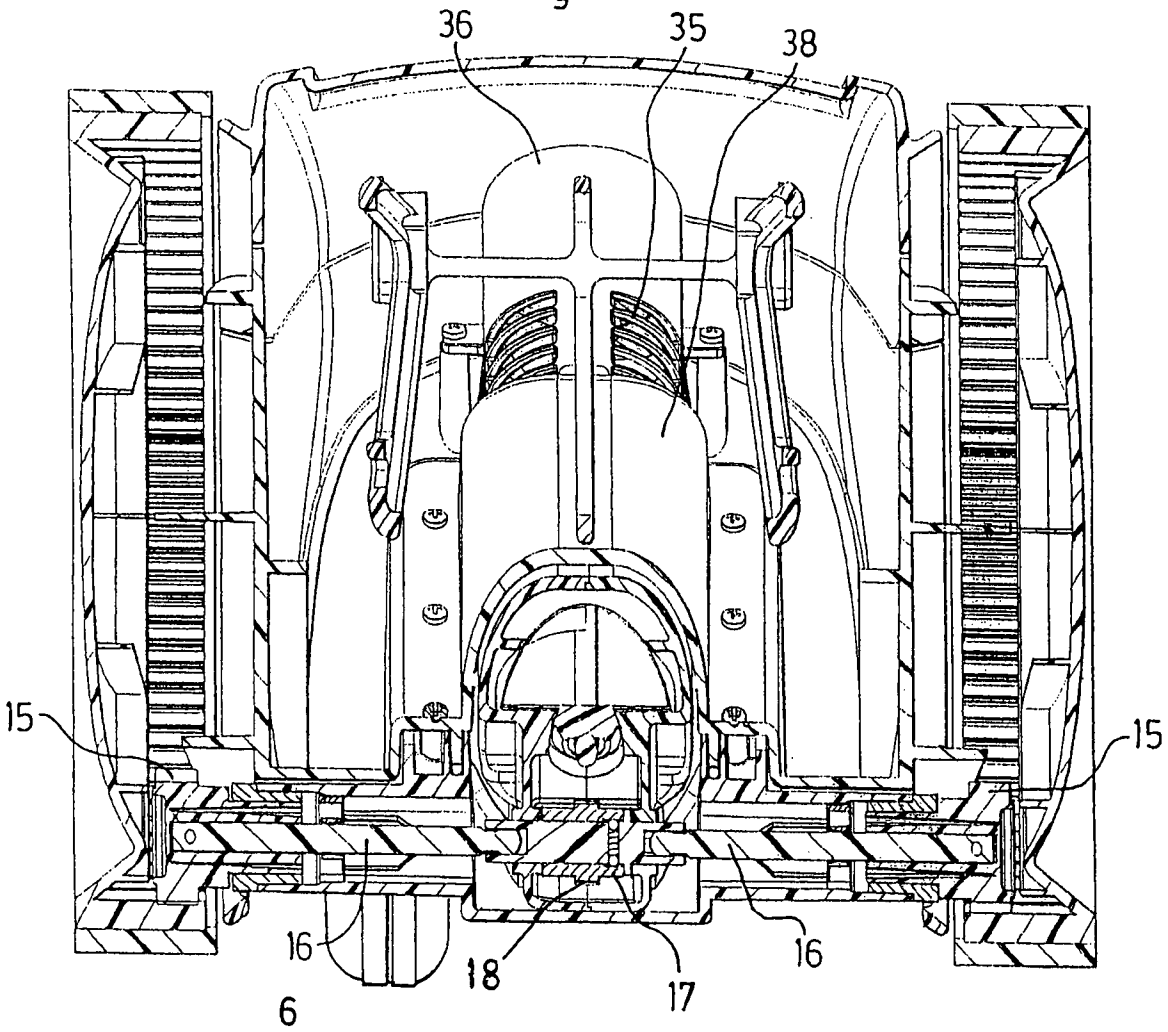
Figure 8A:
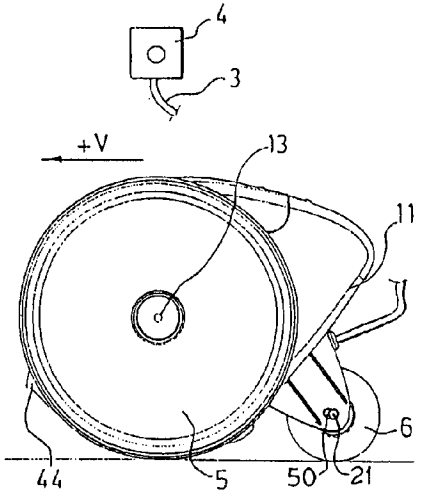
Figure 8B:
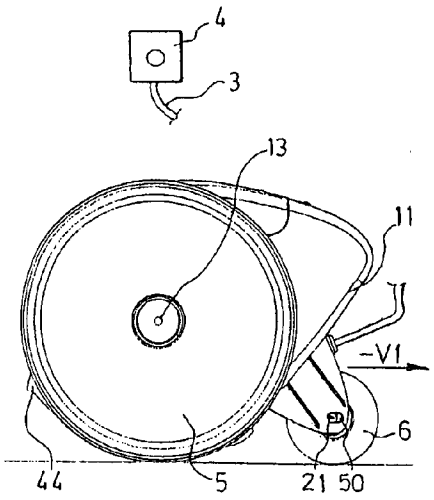
Figure 8C:
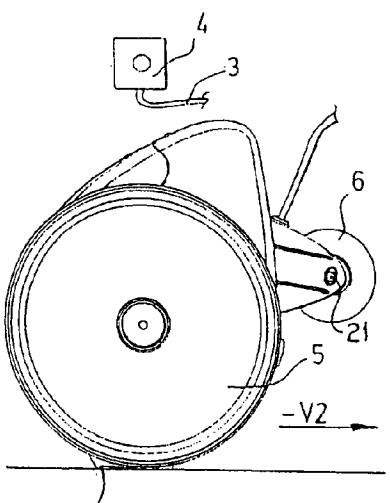
Figure 9A:
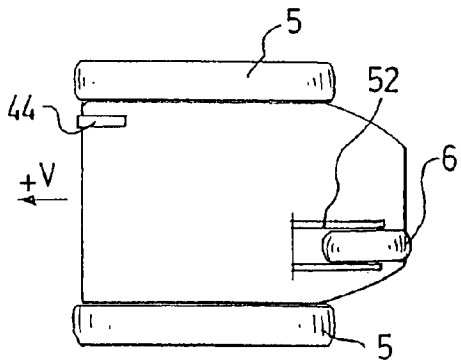
Figure 9B:
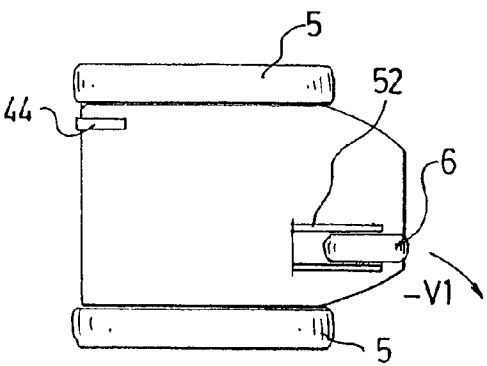
Figure 9C:
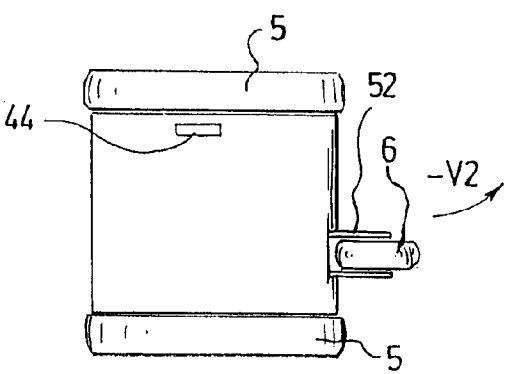

Other objects, features and advantages of the invention will be appreciated from a reading of the following description, which is given by way of non-limiting example and with reference to the appended Figures, in which:

FIG. 1 is a schematic view of the rear of an apparatus according to one embodiment of the invention, FIG. 2 is a schematic bottom view of the apparatus of FIG. 1, FIG. 3 is a schematic profile view of the apparatus of FIG. 1, FIG. 4 is a schematic section through a longitudinal vertical plane of an apparatus according to the invention, with the small rear wheel being partially sectioned and broken-away, illustrating the apparatus driven in a normal forward cleaning direction, FIG. 5 is a schematic section similar to FIG. 4, illustrating the apparatus according to the invention driven in a backward direction and in a nosed-up position, FIG. 6 is a schematic section towards the rear along line VI-VI of FIG. 4, FIG. 7 is a schematic section towards the front along line VII-VII of FIG. 4, FIGS. 8*a* to 8*c* are schematic profile views of an apparatus according to the invention in a forward direction in a normal movement position, in a backward direction in a non nosed-up position and in a backward direction in a nosed-up position, respectively, FIGS. 9*a* to 9*c* are schematic bottom views of FIGS. 8*a* to 8*c*, respectively.

An apparatus according to the invention illustrated in the Figures is a self-propelling apparatus for cleaning an immersed surface which, in the example illustrated, is of the electrical type and is connected only by an electric cable 3 to a control unit 4 located out of the liquid. All along the text, unless indicated otherwise, the apparatus is described in a state moving over an immersed surface which is assumed to be horizontal. Of course, the apparatus according to the invention can move equally well on non-horizontal surfaces, in particular inclined or vertical surfaces.

This apparatus comprises a hollow body 1 which is formed by different walls of rigid synthetic material which are fitted to each other which, on the one hand, allows a filtration chamber 2 to be delimited and which, on the other hand, allows a chassis to be formed which receives and carries guiding and driving members 5, 6, a single electric motor 8 which has a drive shaft 9, a mechanical transmission between the drive shaft 9 of the electric motor 8 and at least one guiding and driving member, called a motorized member 5, and an axial pumping propeller 10.

In the embodiments illustrated, the hollow body 1 has a rear lower shell 11 which forms a chassis, supplemented by a front upper cover 12 which can be removed from the shell 11. The cover 12 is provided with a front transverse handle 47 which allows the apparatus to be handled and transported.

The shell 11 has two large lateral front drive wheels which are coaxial and which have the same diameter. The drive wheels 5 have the largest diameter possible which does not increase the vertical spatial requirement of the apparatus. That is to say, the diameter of the front wheels 5 corresponds to the overall height (dimension in the direction normal with respect to the rolling plane 22 on the immersed surface) of the apparatus according to the invention. For example, the diameter of the front wheels 5 is between 250 mm and 300 mm, in particular in the order of 275 mm.

These large wheels 5 have been found to afford significant and unexpected advantages. First of all, they prevent any untimely contact of a protruding portion of the hollow body on the immersed surface and thus allow this immersed surface to be protected to some degree during the operation of the apparatus. In turn, they provide a degree of protection for the hollow body itself with respect to impacts from external objects which only come into contact with the large wheels 5. They also ensure improved traction of the apparatus using the same electric motor. They are further particularly advantageous in the context of an apparatus which has at least one nosed-up position (inclination in a plane which contains the movement direction and which is orthogonal with respect to the immersed surface) in at least one drive direction in so far as they considerably facilitate this nosing-up action. They limit the risks of blockage on the irregularities (in particular hollows and/or reliefs) of the small immersed surface and have multiple contact zones and different orientations (top, front, bottom) with the immersed surface. By providing particularly efficient and effective driving and guiding, they allow the performance levels and features of the other required guiding members to be reduced (simple small wheel 6 in the examples illustrated), even allow them to be dispensed with (variant which is not illustrated). They also allow a transmission to be produced which is as direct as possible (without any intermediate gear stage) between the drive shaft and each wheel 5 which can be provided, to this end, with an internal toothed crown which is provided with a plurality of teeth and which produces a large step-down action in a single stage. They are particularly advantageous in combination with a motor 8 having an inclined axis as described below.

The front wheels 5 are coupled via a mechanical transmission to the drive shaft 9 of the electric motor 8 and are therefore rotatably driven thereby. They thus form a front drive axle 7. Each front wheel 5 is guided in rotation on the shell 11 about a fixed transverse axis 13 which defines the axis of the front axle 7. Each front wheel 5 has an internal toothed crown 14 allowing to receive a pinion 15 which is mounted at the end of a half-drive-shaft 16 which is coupled to a central bridge 17 which comprises a pinion 18 which is rotatably driven by an endless screw 19 at a front lower end 20 of the drive shaft 9. In this manner, when the drive shaft 9 is rotatably driven in one direction by the motor 8, the pinion 18 is rotatably driven in one direction, and each pinion 15 is also rotatably driven in one direction, which drives the corresponding front wheel 5 in one direction. When the drive shaft 9 is rotatably driven in the other direction, the pinions 18 and 15 are rotatably driven in the other direction, as are the front wheels 5. In this manner, the motor 8 allows the front drive wheels 5 to be driven in one or other of the two rotation directions, forwards and backwards.

The shell 11 also carries a small rear wheel 6 which can freely rotate (not coupled to the drive shaft 9 and therefore non-driving) about a transverse axis 21 in a cover which is integral with the shell 11. This small wheel 6 constitutes a guiding member which, in the example illustrated, does not carry out the driving function. Furthermore, its axis 21 is and always remains fixed and parallel with the axis 13 of the drive axle 7. More generally, the axis 21 of the small wheel 6 is and remains parallel with the rotation axis of each rolling drive guiding member 5 (the apparatus being able to comprise rolling drive guiding members which are not necessarily coaxial and located on the same drive axle as the wheels 5 in the embodiment illustrated; nonetheless in this instance, the axes of the various rolling drive guiding members are fixed relative to the hollow body and mutually parallel in order to drive the apparatus in the same instantaneous drive orientation) and orthogonal relative to the instantaneous drive orientation, that is to say, the normal advance direction of the apparatus. In this manner, the small rear wheel 6 constitutes a non-steering, non-driving rolling guiding member. In the preferred embodiment illustrated, the small rear wheel 6 is the only non-steering non-driving rolling member, and therefore on its own forms a non-steering, non-driving axle which is longitudinally offset relative to the drive axle 7, these two axles being parallel.

The two front wheels 5 and the small rear wheel 6 define the same plane, called a rolling plane 22, which corresponds to the immersed surface when the apparatus is moving normally over the surface with a cleaning action, all the wheels 5, 6 being in contact with the immersed surface.

The single electric motor 8 acts not only as a drive motor for the drive wheels 5 but also as a pumping motor which drives the propeller 10 in rotation about the axis thereof. To this end, the drive shaft 9 of the motor 8 extends longitudinally through the body of the motor and opens axially so as to protrude at both sides of the body of the motor, that is to say, with a front lower end 20 which drives the wheels 5 as indicated above and a rear upper end 23, to which the pumping propeller 10 is directly coupled so as to be fixedly joined in rotation.

The shell 11 carries the electric motor 8 in an inclined position relative to the rolling plane 22, that is to say, with the drive shaft 9 (which opens axially at the two sides of the body of the motor) inclined through an angle $\alpha$ which is not 0° or 90° relative to the rolling plane 22. In particular, the drive shaft 9 is not orthogonal relative to the rolling plane 22. The angle $\alpha$ of inclination is between 30° and 75°, for example in the order of 50°. The angle $\alpha$ is also the inclination angle of the axis of the propeller 10 and the orientation 24 of the hydraulic flux generated thereby. The angle $\alpha$ also corresponds to the general orientation of the hydraulic reaction generated by the flux of liquid at the outlet 37 in the normal pumping direction and towards the filter 33 in a backward direction.

Such an inclination has a number of advantages, and in particular allows a great compactness to be conferred on the apparatus according to the invention and allows the force of the hydraulic reaction resulting from the liquid flow generated by the propeller 10, in particular its component parallel with the rolling plane 22, to be used for driving the apparatus in a normal direction.

The shell 11 also has a lower opening 25 which extends transversely substantially over the entire width and which is slightly offset towards the front relative to the vertical transverse plane (orthogonal with respect to the rolling plane 22) which contains the axis 13 of the drive axle 7. This opening 25 forms a liquid inlet at the base of the hollow body in the normal pumping direction for cleaning the immersed surface.

This opening 25 preferably has a flap 26 which extends along the rear edge thereof and at the sides in order to facilitate the suction of the debris. The opening 25 preferably also has a rib 29 which extends along its front edge, protruding downwards, in order to create a turbulence effect at the rear of this rib 29 tending to disengage the debris from the immersed surface and accelerate the flow of liquid entering the opening 25.

The opening 25 is arranged to receive a lower end 27 of an inlet conduit 28 which is integral with the cover 12.

The assembly constitutes a liquid inlet at the base of the hollow body 1, via which the liquid is drawn in by the suction resulting from the pumping propeller 10 when it is driven in a normal pumping direction by the motor 8.

The conduit 28 generally extends over the entire width of the cover 12 and upwards (substantially orthogonally with respect to the rolling plane 22) as far as an upper opening 30 which is provided with a pivoting shutter 31 which acts as a valve. The shutter 31 is articulated about a horizontal transverse axis 32 located at the front of the opening 30. The cover 12 is arranged to be able to receive and carry a filter 33 which extends at the rear of the conduit 28 so as to receive the liquid flow (loaded with debris) from the upper opening 30 of the inlet conduit 28. This filter 33 is formed by rigid filtering walls and is in liquid communication at the upper rear portion 34 thereof with an inlet 35 of a conduit 36 which receives the axial pumping propeller 10, this conduit 36 generally extending in the pumping orientation 24 of the liquid, in the continuation towards the rear towards the top of the drive shaft 9, as far as an outlet 37 for liquid out of the hollow body 1 via which the liquid is generally discharged in the direction 24 when the propeller 10 is driven by the motor 8 in the normal pumping orientation. The path of liquid in the normal pumping direction in the hydraulic circuit for liquid circulation thus formed between the liquid inlet 25 and the liquid outlet 37 through the filter 33 is illustrated schematically by arrows in FIG. 4.

The motor 8 is carried below an inclined fluid-tight lower wall 38 of the shell 11 which delimits the filtration chamber 2 which receives the filter 33. The upper end 23 of the drive shaft 9 extends through the fluid-tight wall 38 in a portion 39 thereof which forms the lower portion of the conduit 36 and this passage itself is fluid-tight, that is to say, is produced by a device 40 having a sealing joint(s) (for example of the stuffing box type) which provide(s) the sealing between the rotating drive shaft 9 and the wall 38.

The main liquid outlet 37 out of the hollow body 1 is provided with a protective grill 41 which guides the flux generated in a normal pumping direction and which prevents the passage of debris in the backflow direction towards the inner side of the hollow body 1 when the propeller 10 is driven in a backward direction counter to the normal pumping direction.

The control unit 4 is preferably located out of the liquid and is configured to provide, via the cable 3, a supply voltage to the motor 8. This supply voltage, depending on its polarity, allows the motor 8 to be controlled in one direction or the other and in accordance with different rotation speeds. Such a control unit 4 can be formed by an electrical power supply which is branched with respect to the mains supply and which comprises a pulse width modulation control logic unit which controls a circuit which forms a voltage source (based on at least one transistor in commutation) whose output is chopped at high frequency with a pulse width which is variable in accordance with the signal provided by the control logic unit. The control unit 4 comprises an inversion circuit which allows a supply voltage to be provided for the motor 8 whose polarity can be changed (positive polarity for driving in a forward direction; negative polarity for driving in a backward direction) and whose mean value can be modified owing to the pulse width modulation logic in order to take up a value from a plurality of different values which correspond to several drive speeds of the motor 8, respectively, and therefore to several movement speeds of the apparatus. The sign + indicates a movement in a forward direction; the sign – indicates a movement in a backward direction. In the example, if it is desirable for the apparatus to be able to move at a normal predetermined speed +V in a forward direction, at a first speed −V1 in a backward direction or at a second speed −V2 in a backward direction, the control logic can be programmed so that the control unit 4 provides a voltage whose mean value can take, at an absolute value, a value selected from three predetermined values corresponding to these three speeds.

The control unit 4 may advantageously incorporate a time delay logic unit which allows the various drive directions and the various speeds to be controlled in accordance with periods of time which are predetermined, fixed and stored and/or defined randomly, for example using a pseudo-random variable generator. Such a control unit 4 is particularly simple in terms of its design and production.

In a first rotation direction of the motor 8 and the shaft 9 thereof, the front drive wheels 5 are rotatably driven in the forward movement direction of the apparatus (FIGS. 4 and 8*a*, the small wheel 6 being at the rear of the drive axle 7 in contact with the immersed surface). In this first rotation direction, the axial pumping propeller 10 is driven in the normal pumping direction of the liquid from the opening 25 at the base of the hollow body 1 as far as the outlet 37 via which the liquid is discharged. The shutter 31 is open and the pieces of debris drawn in via the opening 25 with the liquid are retained in the filter 33.

In this first rotation direction, the motor 8 is controlled at a predetermined speed so that the apparatus is moved forwards at a predetermined speed +V, called a normal speed, which is as rapid as possible in order to optimize the cleaning. Preferably, the normal speed +V corresponds to the maximum rotation speed of the motor 8. When the apparatus is thus driven forwards, the trajectory thereof is normally in a straight line orthogonal with respect to the axis 13 of the axle 7, the two front wheels 5 being parallel with each other and orthogonal with respect to the axis 13, and the small wheel 6 being in contact with the immersed surface.

In the other rotation direction of the motor 8, the front drive wheels 5 are rotatably driven in a backward movement direction of the apparatus (FIGS. 5, 8*b*, 8*c*, 9*b*, 9*c*, the small wheel 6 being in front of the drive axle 7 relative to this movement direction). In this second rotation direction, the axial pumping propeller 10 is driven in the opposite direction to its normal pumping direction and generates a non-zero flow of liquid in a backward direction from the outlet 37 towards the inner side of the hollow body 1. The propeller 10 is an axial pumping propeller which has unidirectional pitch and which is preferably fixed (having blades which are rigidly fixed to a rotor and which extend radially relative thereto having a pitch in only one direction) and which generates a flow of liquid which is generally orientated in accordance with the rotation axis thereof (therefore, the propeller 10 not being of the centrifugal type) in one direction or the other in the direction of rotation of the propeller about the axis thereof. The propeller 10 is optimized to generate an optimum flow when it is rotatably driven about its axis in the normal pumping direction. However, when it is rotatably driven about the axis thereof in an opposite direction to that normal pumping direction, the propeller 10 generates a non-zero flow of liquid in a backward direction.

And, against all expectations in this matter, not only is this backward flow in reality not disadvantageous for the general operation of the apparatus, but it is instead particularly advantageous and in particular allows:

- a hydraulic reaction to be applied which can be involved in the nosing-up action of the apparatus which brings about modifications of the trajectory of the apparatus during its movements in a backward direction, in terms of gyration at one side or the other,
- hydraulic fluxes optionally to be generated which are orientated laterally and which are involved directly by means of reaction in the trajectory modifications of the apparatus, in terms of gyration at one side or the other,
- the walls of the filter 33 to be periodically unclogged, which serves to increase the service-life of the apparatus and to optimize the operational volume of the filter 33.

In this second rotation direction of the motor 8, the shutter 31 is automatically in a closed position (owing to gravity and/or under the action of the flux in a backward direction), preventing any backflow of debris into the conduit 28 so that the pieces of debris remain confined inside the filter 33. The flux in a backward direction can be discharged via the inevitable leakages of the apparatus (this being able to have no specific discharge hole or valve for the flux in a backward direction), or via one or more specific hole(s) having valve(s) provided in the shell 11 for this purpose, for example a lateral hole (variant which is not illustrated).

The trajectory modifications of the apparatus during its movements in a backward direction (compared with its trajectory in a forward direction which is in a straight line in the example) are obtained by means of a modification of the distribution of the members which come into contact with the immersed surface, this distribution being asymmetrical in at least one movement configuration of the apparatus in order to produce a gyration torque thereof. Furthermore, in a backward direction, several movement configurations of the apparatus and several distributions corresponding to several different trajectories of the apparatus, respectively, can be obtained. Such a modification of the distribution may result in particular from a modification of the position of the hollow body 1 relative to the axle 7 about the axis 13 (in a plane which is orthogonal with respect to the immersed surface and which contains the movement direction).

The apparatus is configured so as to be able to be driven in terms of gyration at one side (for example to the left relative to its movement direction) for a first speed of the motor 8 corresponding to a first speed −V1 of movement of the apparatus in a backward direction and with a first non-nosed-up position of the apparatus; and in terms of gyration at the other side (for example to the right relative to its movement direction) for a second speed of the motor 8 corresponding to a second speed −V2 of movement of the apparatus in a backward direction and to a second nosed-up position of the apparatus, this second speed −V2 being different, in particular more rapid, than the first speed −V1. In this manner, there is obtained in an extremely simple manner an apparatus which, in the forward direction, moves in a straight line and, in a backward direction, depending on the rotation speed of the motor 8, moves by turning to the left or by turning to the right. Consequently, all the useful trajectories of a cleaning apparatus are obtained, which greatly facilitates the cleaning coverage and the rapidity of cleaning the immersed surface.

The increase in the movement speed in a backward direction generates an acceleration which brings about an inertia moment which tends to increase the nosing-up action of the apparatus. The general balance of the apparatus can be adapted in order to obtain the desired positions which are nosed-up to a greater or lesser extent or non-nosed-up, in accordance with the various corresponding speeds.

In a variant which is not illustrated, the pumping device may also be involved in the placement into (a) nosed-up position(s). In this regard, it should be noted that the pumping propeller 10 is a propeller with unidirectional pitch which is directly coupled so as to be fixedly joined in rotation to the rear upper end 23 of the drive shaft 9. An axial pumping propeller with unidirectional pitch comprises blades which generally extend radially and have a pitch which is preferably fixed but which could be variable but which, in any case, does not change direction, that is to say, is always orientated in a single direction, so that the liquid flux direction generated by the rotation of the propeller is dependent on the rotation direction thereof. When the propeller 10 is rotatably driven in the normal pumping direction (corresponding to the cleaning of the immersed surface), it pumps the liquid from each liquid inlet at the base of the hollow body as far as each main liquid outlet. When the propeller 10 is rotatably driven in a backward direction, it pumps the liquid in the direction of the backflow from each main liquid outlet.

The axial pumping propeller 10 which is driven in a backward direction generates a flow of liquid which is able to be discharged from the hollow body via at least one liquid outlet, called a secondary outlet (not illustrated). The liquid flow which is discharged via at least one such secondary outlet is orientated so that this current creates, by means of reaction, forces whose resultant, which is called a secondary hydraulic reaction force, generates a nosing-up torque of the apparatus by pivoting the hollow body about the axle 7. This nosing-up torque about the axis 13 of the drive axle 7 tends to nose-up the apparatus, that is, raise the small wheel 6. In this manner, such a secondary hydraulic reaction force applies a pivot torque of the apparatus about the axis 13 of the drive axle 7 in the direction in which the nosing-up action of the apparatus is increased. To this end, it is necessary and sufficient for the orientation of the liquid flux generated in a backward direction and being discharged via such a secondary outlet not to intersect with the axis 13 of the drive axle 7, and to be orientated in the correct direction in order to at least participate in the nosing-up action of the hollow body about the nosing-up axle. However, such an involvement of the liquid flow in a backward direction in placing the apparatus in a nosed-up state is not necessary and, in the embodiment illustrated by way of example, obtaining each nosed-up position results only from the drive torque on the drive axle and the general balance of the apparatus.

Trajectory modifications can be obtained by means of different configurations of the guiding members in contact with the immersed surface and/or by means of laterally offset braking members which may or may not come into contact with the immersed surface in accordance with the position of the apparatus which may be nosed-up to a greater or lesser extent or non-nosed-up, that is to say, in accordance with the inclination of the hollow body 1 about the axis 13 of the drive axle 7 relative to the immersed surface.

In the embodiments illustrated, the shell 11 has a wall portion 42 which extends forwards from the opening 25, over the entire width thereof, substantially conforming to the contour of the front wheels 5. This wall portion 42 is provided, in the first embodiment illustrated, with at least one runner 44 which is arranged so as to be able to come into contact with the immersed surface in order to locally brake and/or disengage the hollow body 1 in a movement configuration of the apparatus.

In the embodiment illustrated, the apparatus is advantageously provided with a cleaning scraper 45 which is freely articulated about a transverse axis 46 (parallel with the axis 13 of the drive axle 7) in order to come into contact with the immersed surface by means of pivoting about this axis under the action of gravity and to scrape the immersed surface when the apparatus moves in a normal forward cleaning direction at the speed +V. The scraper 45 extends at the rear of the inlet opening 25 so as to disengage the debris from the immersed surface so that they are driven by the suction of the liquid into this opening 25 under the action of the pumping when the motor 8 is controlled in a normal direction, the apparatus being moved forwards.

According to the invention, the small rear wheel 6 is arranged so as to be laterally offset relative to the longitudinal vertical center plane of symmetry of the hollow body. In this manner, this small wheel 6 is carried by a cover 52 which, in the example illustrated, is offset at the right-hand side (when viewed relative to the forward direction) of the shell 11. Owing only to this, the occurrences of friction brought about by the rolling of the small wheel on the immersed surface are not symmetrical relative to the instantaneous drive orientation of the apparatus determined by the drive axle 7 and produce a gyration of the apparatus when it is driven backwards at a slow speed −V1, in accordance with a normal movement position in which the small wheel 6 is in contact with the immersed surface. The gyration produced in this manner is, in the example illustrated, orientated to the left relative to the backward movement direction, as illustrated in FIG. 9*b*. In contrast, when the apparatus is driven in a forward movement direction at a speed +V, the displacement of the small rear wheel 6 substantially produces no gyration torque so that the trajectory of the apparatus is normally straight. It should be noted that, in the forward movement direction, the drive torque on the drive wheels 5 tends to minimize the application force of the small wheel 6 on the immersed surface whilst, in the backward movement direction, the drive torque on the drive wheels 5 in contrast tends to increase this application force and therefore the horizontal component of the friction reaction which, owing to its lateral displacement, produces a gyration effect. It should also be noted that the small wheel 6 has its rotation axis 21 which is and always remains parallel with the axis 13 of the drive axle, that is to say, this small wheel 6 is not a pivoting wheel and is therefore not a steering wheel.

In order to reinforce the gyration effect, the cover 52 is preferably provided with a braking surface 51 and the axis 21 of the small wheel 6 is guided relative to the cover 52 by means of an aperture 50 which is oblong in the longitudinal direction. The assembly is adapted so that:

- when the apparatus is moved forwards, the axis 21 of the small wheel 6 moves into abutment at the rear of the oblong aperture 50, the small wheel 6 not coming into contact with the braking surface 51 and thus being able to rotate freely (FIG. 3),
- when the apparatus is moved backwards, the axis 21 of the small wheel 6 remains transverse (orthogonal with the instantaneous drive direction imparted by the drive wheels 5) and moves into abutment at the front of the oblong aperture 50, the small wheel 6 coming into contact with the braking surface 51 and being braked thereby so that it can no longer rotate and provides significant braking resistance on the immersed surface (FIG. 8*b*).

In the normal position of the apparatus and when it is moving backwards at low speed, the apparatus is therefore driven in terms of gyration at one side (to the left relative to the movement direction in the example illustrated) in a backward direction owing to the laterally offset localized braking action imparted by the small wheel 6 on the immersed surface.

A fixed runner 44 is arranged at one side, for example at the left-hand side as illustrated, so as to be integral with the front portion 42 of the shell 11 and extends so as to protrude radially outwards from this portion 42 in order to come into contact with the immersed surface when the apparatus is in a nosed-up position illustrated in FIG. 8*c*, having a greater inclination than the normal position. This nosed-up position is obtained for the second rapid movement speed −V2 in a backward direction corresponding to the second rapid rotation speed of the motor 8. In this nosed-up position, the small wheel 6 is no longer in contact with the immersed surface and the apparatus is driven in terms of gyration at the other side (to the right in the example illustrated) and in a backward direction owing to the friction of the runner 44 on the immersed surface and/or disengagement of the front left wheel 5. The runner 44 is also arranged in front of the drive axle 7 and, in this nosed-up position, comes into contact with the immersed surface at the rear of the drive axle relative to the movement direction (backward direction). In the normal position of the apparatus, the runner 44 is not in contact with the immersed surface.

It should be noted that the control of the nosed-up position of the apparatus does not require a particularly complex operational logic unit in so far as it can be obtained by means of simple balance of the apparatus during production. Furthermore, the presence of the runner 44 facilitates this control by acting as a stop which limits the pivoting in a nosed-up position. Furthermore, this control can remain relatively imprecise in so far as the periods of time for placing the apparatus in a nosed-up position are short, this movement configuration not corresponding to the normal cleaning configuration.

The small rear wheel 6 is arranged so as to come into contact with the immersed surface only in said normal position in which all the wheels 5 and the small wheel 6 are in contact with the immersed surface, and the runner 44 is arranged so as to come into contact with the immersed surface only in said nosed-up position. In particular, in the normal position, the runner 44 is not in contact with the immersed surface. In the normal movement position of the apparatus in which it is not nosed-up, all the wheels 5, 6 being in contact with the immersed surface, and during movements in a forward direction, the runner 44 is remote from the immersed surface and therefore inactive.

A runner 44 which is capable of disengaging a drive wheel 5 produces a rapid gyration of the apparatus by means of localized stoppage. A runner 44 which is capable of rubbing on the immersed surface without disengaging a drive wheel 5 produces a slower gyration of the apparatus by means of localized braking. These two variants can be envisaged in an apparatus according to the invention and can be combined (at least one braking runner being provided to rub only on the immersed surface and locally brake in one position of the apparatus; at least one other disengaging runner disengaging a wheel in another position of the apparatus).

The control unit 4 is extremely simple in terms of its design and production. It is configured so that the apparatus is principally driven forwards in a straight line. The motor 8 is interrupted from time to time and controlled in a backward direction at the first slow speed (corresponding to the movement speed −V1) from time to time and at the second rapid speed (corresponding to the movement speed −V2) from time to time. The different time periods for control of the motor 8: T1 in a forward direction at rapid speed +V, T2 in a backward direction at slow speed −V1, T3 in a backward direction at normal rapid speed −V2, and T4 the interruptions of the motor 8, are defined in a random manner (by a random generator, that is to say, a pseudo-random variable generator) and/or in a predetermined manner. Preferably, these time periods can be defined so as to limit the entanglement of the cable 3, that is to say, ensuring that the totals of the periods of time of gyration to the left are similar to the totals of the periods of time of gyration to the right.

For example, T1 is between 10 sec. and 1 min., for example in the order of 20 sec.; T2 and T3 are both less than T1, for example between 3 sec. and 15 sec., in particular between 5 sec. and 8 sec.; and T4 is less than each of the periods of time T1, T2 and T3 and is between 0.5 sec. and 5 sec., in particular in the order of 2 sec. The value V corresponds to the maximum speed of the motor 8 (no pulse width modulation of the voltage supplied by the control unit 4), V1 corresponds to 50% of the maximum speed of the motor (V1=0.5V) and V2 corresponds to 80% of the maximum speed of the motor (V2=0.8V). Of course, other values are possible.

The apparatus according to the invention is extremely simple in terms of design and construction and therefore very economical but very efficient. With a single electric motor 8 and a control unit 4 which is reduced to its most simple form, all the most complex functionalities of an electrical apparatus are obtained. The apparatus according to the invention is further particularly light, easy to handle, ergonomic and particularly aesthetic. It consumes very little energy and is environmentally friendly. It has a great service-life and excellent inherent reliability in particular of the small number of components which it contains.

The invention may include numerous variants from the preferred embodiments illustrated in the Figures and described above. In particular, the invention can be used equally well in an apparatus which is provided with motorized or non-motorized guiding and driving members other than wheels (chains, brushes, etc.). The small rear wheel 6 may in particular be replaced by a non-steering non-driving axle which comprises several wheels or small wheels, but which are laterally offset relative to the drive wheels 5. That is to say, the barycentre of the drive wheels on the axis 13 of the drive axle 7 is laterally offset relative to the barycentre of the non-steering non-driving axle.

The apparatus may also have several liquid inlets, several liquid outlets, even several pumping propellers which are driven by the same motor. However, one advantage of an apparatus according to the invention is that it is able to have only one liquid inlet 25, only one liquid outlet 37, only one hydraulic circuit and a single axial pumping propeller 10 which is coupled directly to the drive shaft 9 of the electric motor 8. The motor 8 can be driven in accordance with a discrete plurality of speeds which may comprise more different speeds than in the example described above.

The apparatus according to the invention advantageously has no actuator or on-board logic circuit and/or electronic circuit. In variants, there is nothing to prevent the apparatus from being able to comprise, if necessary, on-board electronic components and/or actuators. For example, the control unit could be on-board, including for example with a series of on-board accumulators which act as a source of electrical energy, the apparatus being completely independent.

The members of the apparatus which come into contact with the immersed surface in the various movement configurations of the apparatus may be extremely varied and comprise any wheels, small wheel(s), scraper(s), runner(s), brush(es), roller(s), belt(s), chain(s) since, in at least one movement configuration, a gyration torque is created by a non-symmetrical distribution of at least one non-steering, non-driving rolling guiding member relative to the longitudinal center direction of the apparatus and relative to the instantaneous drive orientation, a non-symmetrical distribution which generates local braking by means of friction which may be sliding or non-sliding, rolling or non-rolling and also non-symmetrical.

The invention claimed is:

1. An apparatus for cleaning a surface which is immersed in a liquid, comprising:

a body, at least one electric motor which is carried by said body and which comprises a drive shaft, at least one guiding and driving member mechanically connected to the drive shaft and arranged so as to move the body over the immersed surface in an instantaneous drive orientation, at least one liquid inlet into the body, at least one liquid outlet out of the body, a filtering device for filtering at least some liquid passing through the inlet, an electric control unit which is configured to control the at least one electric motor, and means, comprising at least one non-steering non-driving rolling guiding member rotatably mounted relative to the body about a transverse axis generally orthogonal to the instantaneous drive orientation, for applying a gyration torque of the apparatus for at least one movement configuration of the apparatus on the immersed surface.

2. An apparatus as claimed in claim 1, in which the body defines a longitudinal center plane and the at least one non-steering non-driving rolling guiding member is laterally offset from the longitudinal center plane.

3. An apparatus as claimed in claim 1 having first and second movement configurations and, (a) for the first movement configuration, the at least one non-steering non-driving rolling guiding member causing movement of the apparatus according to a first trajectory and (b) for the second movement configuration, the at least one non-steering non-driving rolling guiding member causing movement of the apparatus according to a second trajectory differing from the first trajectory.

4. An apparatus as claimed in claim 3, wherein said first movement configuration corresponds to a first movement direction of the apparatus and the second movement configuration corresponds to a second movement direction of the apparatus opposite said first movement direction.

5. An apparatus as claimed in claim 1, wherein the at least one non-steering non-driving rolling guiding member rotates freely about the transverse axis in a first movement direction of the apparatus, further comprising a brake for braking the at least one non-steering non-driving rolling guiding member in a second movement direction of the apparatus.

6. An apparatus as claimed in claim 1 further comprising a drive axle about which the at least one guiding and driving member rotates, the drive axle being parallel to the transverse axis.

7. An apparatus as claimed in claim 6 in which (a) the drive axle defines a central plane orthogonal to the transverse axis and (b) the at least one non-steering non-driving rolling guiding member is laterally offset from the central plane.

8. An apparatus as claimed in claim 6 further comprising an axial pumping propeller arranged so as to generate a flow of liquid between the at least one liquid inlet and the at least one liquid outlet, and in which the drive shaft is simultaneously coupled to the drive axle and the axial pumping propeller.

9. An apparatus as claimed in claim 8 in which the electric control unit is configured to control the drive shaft in (a) a first direction at a first speed and (b) a second direction at a speed selected from a second speed at which the apparatus moves into a first movement position and a third speed at which the apparatus moves into a second, nosed-up movement position.

10. An apparatus as claimed in claim 8 in which (a) the drive shaft is configured to rotate in opposite first and second directions and (b) the axial pumping propeller is configured to rotate in (i) a normal direction when the drive shaft rotates in the first direction and (ii) a backward direction when the drive shaft rotates in the second direction.

11. An apparatus as claimed in claim 10 in which, when the drive shaft rotates in the second direction, the electric control unit rotates the drive shaft at a speed selected from:

a first slow speed at which the apparatus is in a first movement position relative to the immersed surface and moves in a backward direction in accordance with a first predetermined trajectory, or a second rapid speed at which the apparatus is in a second, nosed-up movement position in which it is at least partially raised relative to the immersed surface by means of pivoting about the drive axle, by means of which the apparatus moves in a backward direction in accordance with a second predetermined trajectory differing from the first predetermined trajectory.

12. An apparatus as claimed in claim 11, wherein said electric control unit is configured to control the at least one electric motor principally in a forward direction, and to control the at least one electric motor from time to time in a backward direction in the first slow speed and from time to time in the backward direction in the second rapid speed.

13. An apparatus as claimed in claim 1, wherein (a) the at least one non-steering non-driving rolling guiding member is, for at least one movement configuration of the apparatus on the immersed surface, arranged relative to the instantaneous drive orientation so as to apply the gyration torque and (b) the gyration torque is due only to the arrangement of the at least one non-steering non-driving rolling guiding member relative to the instantaneous drive orientation.

14. An apparatus for cleaning a surface which is immersed in a liquid, comprising:

a body, at least one electric motor which is carried by said body and which comprises a drive shaft, at least one guiding and driving member mechanically connected to the drive shaft and arranged so as to move the body over the immersed surface in an instantaneous drive orientation, at least one liquid inlet into the body, at least one liquid outlet out of the body, a filtering device for filtering at least some liquid passing through the inlet, an electric control unit which is configured to control the at least one electric motor, and means, comprising at least one non-steering non-driving rolling guiding member (a) rotatably mounted relative to the body about a transverse axis generally orthogonal to the instantaneous drive orientation and (b) disconnected from the at least one electric motor, for applying a gyration torque of the apparatus for at least one movement configuration of the apparatus on the immersed surface.

* * * * *